US009953582B2

(12) United States Patent
Kimura et al.

(10) Patent No.: US 9,953,582 B2
(45) Date of Patent: Apr. 24, 2018

(54) GRAY-SCALE VOLTAGE GENERATING CIRCUIT AND DISPLAY UNIT

(71) Applicant: Sony Corporation, Tokyo (JP)

(72) Inventors: Kei Kimura, Kanagawa (JP); Junichi Yamashita, Tokyo (JP)

(73) Assignee: SONY CORPORATION, Tokyo (JP)

( * ) Notice: Subject to any disclaimer, the term of this patent is extended or adjusted under 35 U.S.C. 154(b) by 259 days.

(21) Appl. No.: 14/184,838

(22) Filed: Feb. 20, 2014

(65) Prior Publication Data

US 2014/0285537 A1 Sep. 25, 2014

(30) Foreign Application Priority Data

Mar. 21, 2013 (JP) ..... 2013-058300

(51) Int. Cl.
*G09G 5/10* (2006.01)
*G09G 3/3291* (2016.01)

(52) U.S. Cl.
CPC ... *G09G 3/3291* (2013.01); *G09G 2300/0852* (2013.01); *G09G 2300/0861* (2013.01); *G09G 2310/027* (2013.01); *G09G 2320/0223* (2013.01); *G09G 2320/0233* (2013.01); *G09G 2320/0276* (2013.01)

(58) Field of Classification Search
CPC ..... G09G 3/32–3/3291; G09G 3/36–3/3696
See application file for complete search history.

(56) References Cited

U.S. PATENT DOCUMENTS 5,381,082 A * 1/1995 Schlicht ..... H03F 1/086 323/280
6,380,794 B1 * 4/2002 Foroudi ..... H03K 19/09448 327/108
2003/0146887 A1 * 8/2003 Mametsuka ..... G09G 3/3291 345/76
2003/0151577 A1 * 8/2003 Morita ..... G09G 3/3688 345/89
2004/0095340 A1 * 5/2004 Nakamura ..... G09G 3/325 345/204
2004/0104870 A1 * 6/2004 Mametsuka ..... G09G 3/3233 345/76
2005/0007393 A1 * 1/2005 Akai ..... G09G 3/3233 345/690

(Continued)

FOREIGN PATENT DOCUMENTS

JP 2007-233109 9/2007

OTHER PUBLICATIONS ("Current Source with Floating Load." Opamp Current Source. eCircuit Center, 2002. Web. Dec. 3, 2015. <http://www.ecircuitcenter.com/Circuits/curr_src1/curr_src1.htm>.*

(Continued)

*Primary Examiner* — Yuzhen Shen
(74) *Attorney, Agent, or Firm* — Chip Law Group

(57) ABSTRACT

A gray-scale voltage generating circuit includes a ladder resistor circuit and a constant current source. The ladder resistor circuit includes a plurality of resistors connected in series to one another, and is configured to output a plurality of gray-scale voltages with different voltage values from ends of the respective resistors. The constant current source is configured to be connected in series to the ladder resistor circuit.

15 Claims, 7 Drawing Sheets

(56) References Cited

U.S. PATENT DOCUMENTS

| | | | | |
|---|---|---|---|---|
| 2006/0192695 | A1* | 8/2006 | Nishimura | G09G 3/3688 341/51 |
| 2006/0232520 | A1* | 10/2006 | Park | G09G 3/3291 345/76 |
| 2007/0063948 | A1* | 3/2007 | Nishimura | G09G 3/3688 345/89 |
| 2008/0316163 | A1* | 12/2008 | Van Den Homberg | G09G 3/3685 345/98 |
| 2009/0167663 | A1* | 7/2009 | Ker | G05F 3/30 345/92 |
| 2013/0200877 | A1* | 8/2013 | Nakatsuka | G05F 3/16 323/313 |
| 2014/0285406 | A1* | 9/2014 | Kimura | G09G 3/3291 345/76 |

OTHER PUBLICATIONS

"Low-Power, 13-Bit Voltage-Output DACs with Serial Interface." MAX535, MAX5351. Maxim Integrated Products, Dec. 1996. Web. <https://www.maximintegrated.com/en/datasheet/index.mvp/id/1480>.*

Haubner, Georg. "Understand the Differences between R2R and String DAC Architectures." Planet Analog. N. p., Oct. 10, 2007. Web. <http://www.planetanalog.com/document.asp?doc_id=527548>.*

* cited by examiner $$I_{oled} = \frac{1}{2}\mu C_{ox}\frac{W}{L}(V_{gs}-V_{th})^2 = \frac{1}{2}\mu C_{ox}\frac{W}{L}\left(\frac{R_{sig}}{R_{gam}}V_{cc}-V_{th}\right)^2 \quad \cdots (1)$$

$$I_{oled}' = \frac{1}{2}\mu C_{ox}\frac{W}{L}(V_{gs}'-V_{th})^2 = \frac{1}{2}\mu C_{ox}\frac{W}{L}\left[\frac{R_{sig}}{R_{gam}}(V_{cc}+\Delta V)-V_{th}\right]^2 \quad \cdots (2)$$

GRAY-SCALE VOLTAGE GENERATING CIRCUIT AND DISPLAY UNIT

CROSS REFERENCE TO RELATED APPLICATIONS

This application claims the benefit of Japanese Priority Patent Application JP 2013-058300 filed Mar. 21, 2013, the entire contents which are incorporated herein by reference.

BACKGROUND

The present disclosure relates to a gray-scale voltage generating circuit and a display unit.

A display unit using a digital image signal as an input includes a digital-analog conversion circuit that converts an input digital image signal into an analog image signal. Types of digital-analog conversion circuit include a gray-scale voltage selecting type digital-analog conversion circuit in which a digital image signal is converted into an analog image signal by selecting one gray-scale voltage corresponding to the digital image signal from a plurality of gray-scale voltages corresponding in number to bits of the digital image signal. As a gray-scale voltage generating circuit that generates a plurality of gray-scale voltages, there is known a gray-scale voltage generating circuit using a ladder resistor circuit that includes a plurality of resistors connected in series to one another and outputs a plurality of gray-scale voltages with different voltage values from ends (nodes) of the respective resistors (for example, refer to Japanese Unexamined Patent Application Publication

SUMMARY

When a gray-scale voltage is generated by resistive voltage division by the ladder resistor circuit, a voltage value of the gray-scale voltage is changed at a resistive voltage division ratio by a power supply tolerance of a reference voltage (power supply voltage) of the gray-scale voltage generating circuit. For example, in a case where a P-channel transistor is used as a drive transistor that drives a light-emitting device, a change amount of a source potential and a change amount of a gate potential (a voltage value of the gray-scale voltage) in the drive transistor are different from each other; therefore, an overdrive voltage of the drive transistor is changed, and as a result, luminance is changed.

Therefore, it is desirable to provide a gray-scale voltage generating circuit capable of reducing luminance change caused by a power supply tolerance, and a display unit using the gray-scale voltage generating circuit to generate an analog voltage (a gray-scale voltage) in digital-analog conversion.

According to an embodiment of the present disclosure, there is provided a gray-scale voltage generating circuit including: a ladder resistor circuit including a plurality of resistors connected in series to one another, and configured to output a plurality of gray-scale voltages with different voltage values from ends of the respective resistors; and a constant current source configured to be connected in series to the ladder resistor circuit.

According to an embodiment of the present disclosure, there is provided a display unit including: a pixel section configured by arranging pixel circuits each including a light-emitting device; a gray-scale voltage generating circuit including a ladder resistor circuit and a constant current source, the ladder resistor circuit including a plurality of resistors connected in series to one another, and configured to output a plurality of gray-scale voltages with different voltage values from ends of the respective resistors, the a constant current source configured to be connected in series to the ladder resistor circuit; and a drive section configured to convert an input digital image signal into an analog image signal by selecting one gray-scale voltage corresponding to the digital image signal from the plurality of gray-scale voltages generated by the gray-scale voltage generating circuit and drive the light-emitting device by the analog signal.

In the gray-scale voltage generating circuit with the above-described configuration or the display unit with the above-described configuration, since gray-scale voltages are generated by an IR drop from a reference voltage (a power supply voltage) of the gray-scale voltage generating circuit caused by a current value I of the constant current source and a resistance value R of the ladder resistor circuit; therefore, a potential difference between the reference voltage and the gray-scale voltage is constant. Thus, even though there is a power supply tolerance, a potential difference between a gate and a source of the drive transistor is not changed; therefore, as long as the drive transistor operates in a saturation region, luminance is not changed.

In the embodiments of the present disclosure, even though there is the power supply tolerance, the potential difference between the gate and the source of the drive transistor is not changed; therefore, luminance change caused by the power supply tolerance is allowed to be reduced.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the technology, and are incorporated in and constitute a part of this specification. The drawings illustrate embodiments and, together with the specification, serve to explain the principles of the technology.

DETAILED DESCRIPTION

Figure 1:
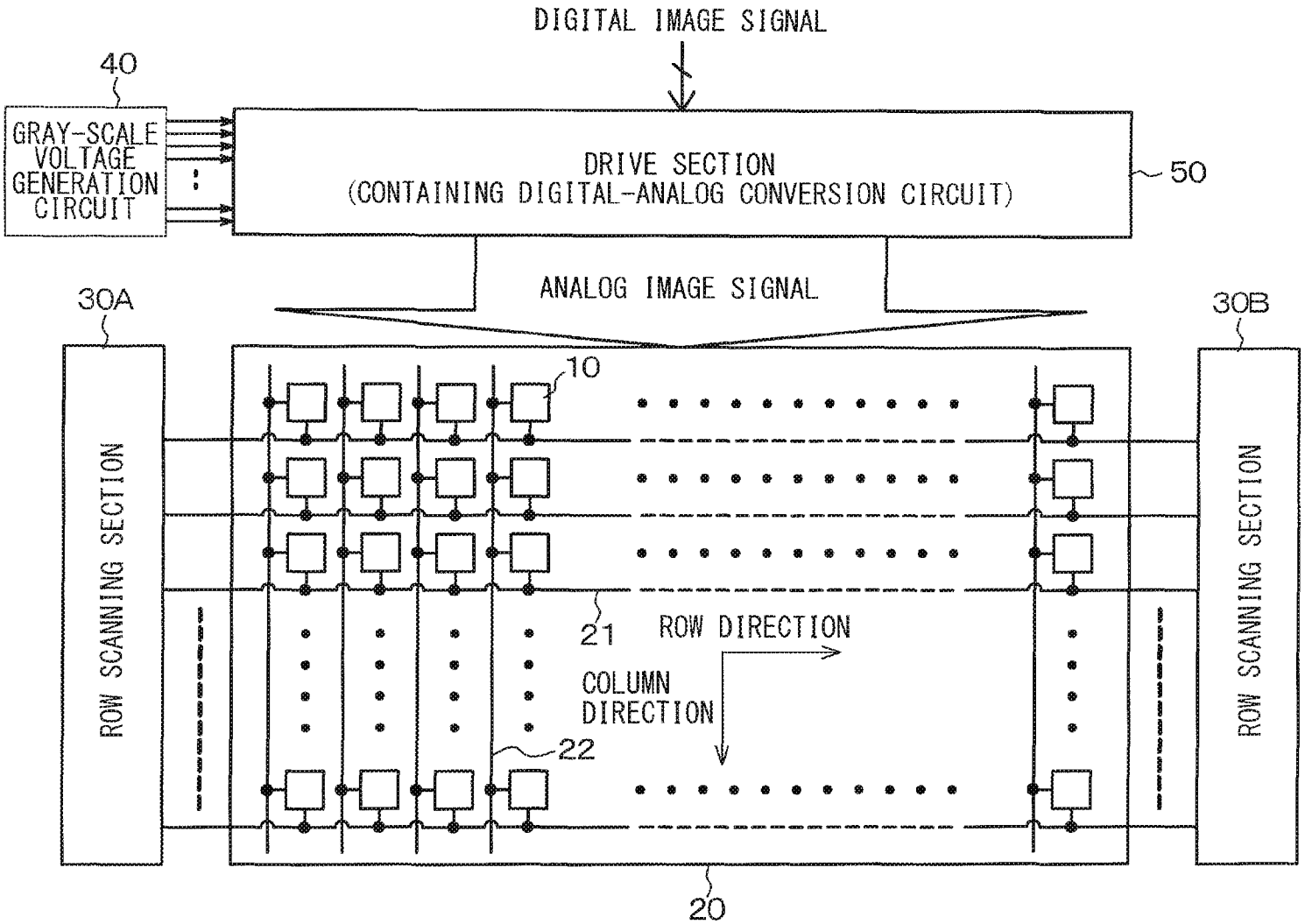
FIG. 1 is a block diagram illustrating a schematic system configuration of an active matrix organic EL display unit according to an application example of an embodiment of the present disclosure.

Some embodiments of the present disclosure will be described detail below referring to the accompanying drawings. The present disclosure is not limited to the embodiments, and various numerical values and materials in the embodiments are merely examples. In the following description, same components or components with same function are denoted by same reference numerals, and description of the components will not be repeated. It is to be noted that description will be given in the following order.

1. General description of gray-scale voltage generating circuit and display unit according to embodiment of present disclosure
2. Display unit to which embodiment of present disclosure is applied
   2-1. System configuration
2-2. Drive section containing DA conversion circuit
   2-3. Pixel circuit
   2-4. About power supply tolerance
3. Description of embodiment
   3-1. Example 1
   3-2. Example 2
4. Configurations of Present Disclosure

1. General Description of Gray-Scale Voltage Generating Circuit and Display Unit According to Embodiment of Present Disclosure A gray-scale voltage generating circuit according to an embodiment of the present disclosure includes a ladder resistor circuit including a plurality of resistors connected in series to one another, and configured to output a plurality of gray-scale voltages with different voltage values from ends of the respective resistors; and a constant current source configured to be connected in series to the ladder resistor circuit.

Moreover, the gray-scale voltage generating circuit according to the embodiment of the present disclosure is used as a gray-scale generating circuit configured to generate a plurality of gray-scale voltages in a display unit that is configured by arranging pixel circuits each including a light-emitting device. The display unit converts an input digital image signal into an analog image signal by selecting one gray-scale voltage corresponding to the input digital image signal from a plurality of gray-scale voltages, and drives the light-emitting devices by the analog image signal.

An example of the light-emitting device of the pixel circuit may be an organic electroluminescence device (hereinafter, simply referred to as "organic EL device") using a phenomenon in which light is emitted by applying an electric field to an organic thin film. The organic EL device is an example of a current-driven light-emitting device (electro-optic device). Examples of the current-driven light-emitting device may include, in addition to the organic EL device, an inorganic EL device, an LED device, and a laser diode device.

An organic electroluminescence display unit (hereinafter, simply referred to as "organic EL display unit") using the organic EL device as a light emission section (a light-emitting device) of a pixel (a pixel circuit) has the following characteristics. Since the organic EL device is allowed to be driven at an applied voltage of 10 V or less, the organic EL display unit features low power consumption. Since the organic EL device is a self-luminous device, the organic EL display unit has higher visibility of an image, compared to a liquid crystal display unit that is also a flat display unit. Moreover, an illumination member such as a backlight is not necessary in the organic EL display unit; therefore, the weight and thickness of the organic EL display unit are easily reduced. Further, the response speed of the organic EL device is extremely high, i.e., about several μsec; therefore, in the organic EL display unit, an afterimage does not occur during displaying of a moving image.

In the gray-scale generating circuit and the display unit with the above-described preferable configuration and mode according to the embodiment of the present disclosure, a constant current source may be configured of a current output amplifier. The current output amplifier may include a current source transistor configured to be connected in series to a ladder resistor circuit, a reference resistor configured to be connected to one of source and drain electrodes of the current source transistor, and a differential amplifier configured to drive the current source transistor, based on a difference voltage between a voltage of a connection node between the current source transistor and the reference transistor and a predetermined reference voltage. At this time, an output voltage of a band gap reference circuit may preferably serve as the predetermined reference voltage.

Moreover, in the gray-scale voltage generating circuit and the display unit with the above-described preferable configuration and mode according to the embodiment of the present disclosure, the reference resistor may be formed in proximity to the resistors of the ladder resistor circuit. At this time, the reference resistor may be preferably formed of a same member as a member of each of the resistors of the ladder resistor circuit or may be preferably formed by a same process as a process of forming each of the resistors of the ladder resistor circuit.

Alternatively, the gray-scale voltage generating circuit and the display unit with the above-described preferable configuration and mode according to the embodiment of the present disclosure may include a voltage setting section configured to select one voltage from a plurality of voltages and set the selected voltage as the predetermined reference voltage that is to be supplied to the differential amplifier. The voltage setting section may include a voltage output section and a voltage selection section. The voltage output section includes a plurality of resistors connected in series to one another between a first power supply and a second power supply, and is configured to output a plurality of voltages from ends of the respective resistors. The voltage selection section is configured to select one voltage from the plurality of voltages as a voltage determining a current that is to flow through the current source transistor. At this time, the voltage selection section may select one voltage from the plurality of voltages, based on variations in characteristics of the differential amplifier.

Alternatively, in the display unit with the above-described preferable configuration and mode according to the embodiment of the present disclosure, the pixel circuit may include a drive transistor that is configured of a P-type transistor and is configured to supply a current corresponding to a gate potential to the light-emitting device. Moreover, a common power supply may be used for the pixel circuits and the ladder resistor circuit. Further, a resistance value of each of the resistors of the ladder resistor circuit may be determined by gamma characteristics of a pixel section.

2. Display Unit to which Embodiment of Present Disclosure is Applied

An active matrix organic EL display unit that uses, as a light emission section (a light-emitting device) of a pixel (a pixel circuit), an organic EL device that is an example of a current-driven light-emitting device will be described as an example of a display unit to which an embodiment of the present disclosure is applied. However, application of the embodiment of the present disclosure is not limited to the organic EL display unit. The embodiment of the present disclosure is applicable to any of display units that convert an input digital image signal into an analog image signal by selecting one gray-scale voltage corresponding to the input digital image signal from a plurality of gray-scale voltages generated by a gray-scale voltage generating circuit, and drive light-emitting devices by the analog image signal.

2-1. System Configuration

FIG. 1 is a block diagram illustrating a schematic system configuration of an active matrix organic EL display unit according to an application example of the embodiment of the present disclosure.

As illustrated in FIG. 1, the active matrix organic EL display unit according to this application example may include a pixel section 20 configured by two-dimensionally arranging pixels 10 each including a light-emitting device (a light emission section) in a matrix form, for example, two row scanning sections 30A and 30B, a gray-scale voltage generating circuit 40, and a drive section 50. In the pixel section 20, scanning lines 21 are wired to respective pixel rows of an arrangement of the pixels in the matrix form, and signal lines 22 are wired to respective pixel columns of the arrangement of the pixels.

The row scanning sections 30A and 30B are disposed on both sides, i.e., a left side and a right side of the pixel section 20. Each of the row scanning sections 30A and 30B is configured of a shift register, an address decoder, and the like. The row scanning sections 30A and 30B sequentially output scanning signals for selection of a row of the pixels 10 of the pixel section 20 to the scanning lines 21 from both sides, i.e., the left side and the right side of the pixel section 20. It is to be noted that, in this case, the row scanning sections 30A and 30B are arranged on both sides, i.e., the left side and the right side of the pixel section 20; however, the row scanning section 30A or 30B may be arranged on only one of the left side and the right side. However, in consideration of delay of transmission of the scanning signal in the scanning line, or the like, the row scanning sections 30A and 30B may be preferably arranged on both sides, i.e., the left side and the right side of the pixel section 20.

Although the gray-scale voltage generating circuit 40 will be described in detail later, the gray-scale generating circuit 40 is configured of a ladder resistor circuit. The ladder resistor circuit includes a plurality of resistors connected in series to one another, and is configured to output a plurality of gray-scale voltages with different voltage values from ends of the respective resistors. The ladder resistor circuit generates gray-scale voltages corresponding in number to bits of a digital image signal input to the drive section 50. For example, in a case where the digital image signal has 8 bits, the ladder resistor circuit generates 256 gray-scale voltages.

The drive section 50 contains a digital-analog conversion circuit (hereinafter, may be referred to as "DA conversion circuit"), and is configured to convert an input digital image signal into an analog image signal by selecting one gray-scale voltage corresponding to the input digital image signal from the plurality of gray-scale voltages generated by the gray-scale voltage generating circuit 40. The analog image signal output from the drive section 50 is supplied, through the signal line 22, to a pixel row selected and scanned by the row scanning sections 30A and 30B, and the light-emitting devices of the pixels 10 in the selected and scanned pixel row are driven to emit light.

2-2. Drive Section Containing DA Conversion Circuit

Figure 2:
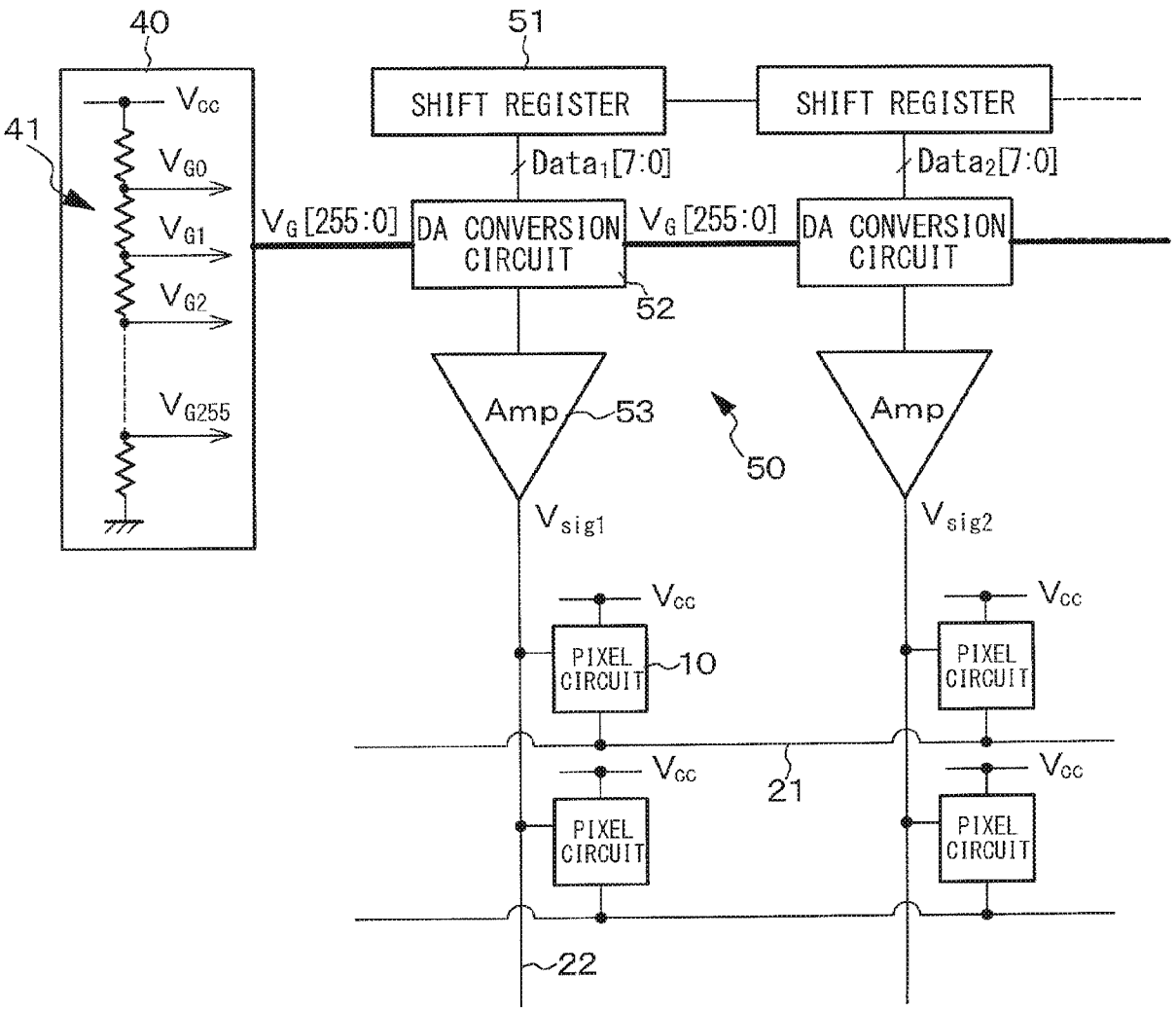
FIG. 2 is a circuit diagram illustrating an example of a configuration of a drive section containing a DA conversion circuit.

FIG. 2 is a circuit diagram illustrating an example of a configuration of the drive section containing the DA conversion circuit. FIG. 2 also illustrates a circuit example of a ladder resistor circuit 41 including a plurality of resistors connected in series to one another in the gray-scale voltage generating circuit 40. In this case, an example in which the digital image signal has 8 bits and the gray-scale generating circuit 30 generates 256 gray-scale voltages $V_{G0}$ to $V_{G255}$ corresponding to the digital image signal is illustrated.

As illustrated in FIG. 2, the drive section 50 has a configuration in which a unit circuit configured of a shift register 51, a DA conversion circuit 52, and an amplifier 53 is provided to each of the pixel columns, i.e., each of the signal lines 22. The shift register 51 outputs 8-bit image data Data [7:0] to the corresponding pixel column. The DA conversion circuit 52 selects one gray-scale voltage corresponding to the image data Data [7:0] output from the shift register 51 from the 256 gray-scale voltages $V_{G0}$ to $V_{G255}$, and outputs the selected gray-scale voltage. The amplifier 53 amplifies the gray-scale voltage output from the DA conversion circuit 52, and outputs the amplified gray-scale voltage as an analog image signal $V_{sig}$ to the signal line 22. Thus, the light-emitting devices of the pixels 10 are driven to emit light.

In the gray-scale voltage generating circuit 40, the ladder resistor circuit 41 has a configuration in which resistors corresponding in number to bits of the digital image signal are connected in series to one another between a first power supply (a power supply on a high potential side) Vcc and a second power supply (a power supply on a low potential side, in this example, a ground GND). A voltage $V_{cc}$ of the first power supply serves as a reference voltage of the gray-scale voltage generating circuit 40 (the ladder resistor circuit 41). In this case, a resistance value of each of the resistors of the ladder resistor circuit 41 may be determined, based on, for example, gamma characteristics of the pixel section 20. Moreover, a power supply on a high potential side of the ladder resistor circuit 41 also serves as the power supplies $V_{cc}$ on the high potential side of the pixels (pixel circuits) 10.

2-3. Pixel Circuit

Figure 3:
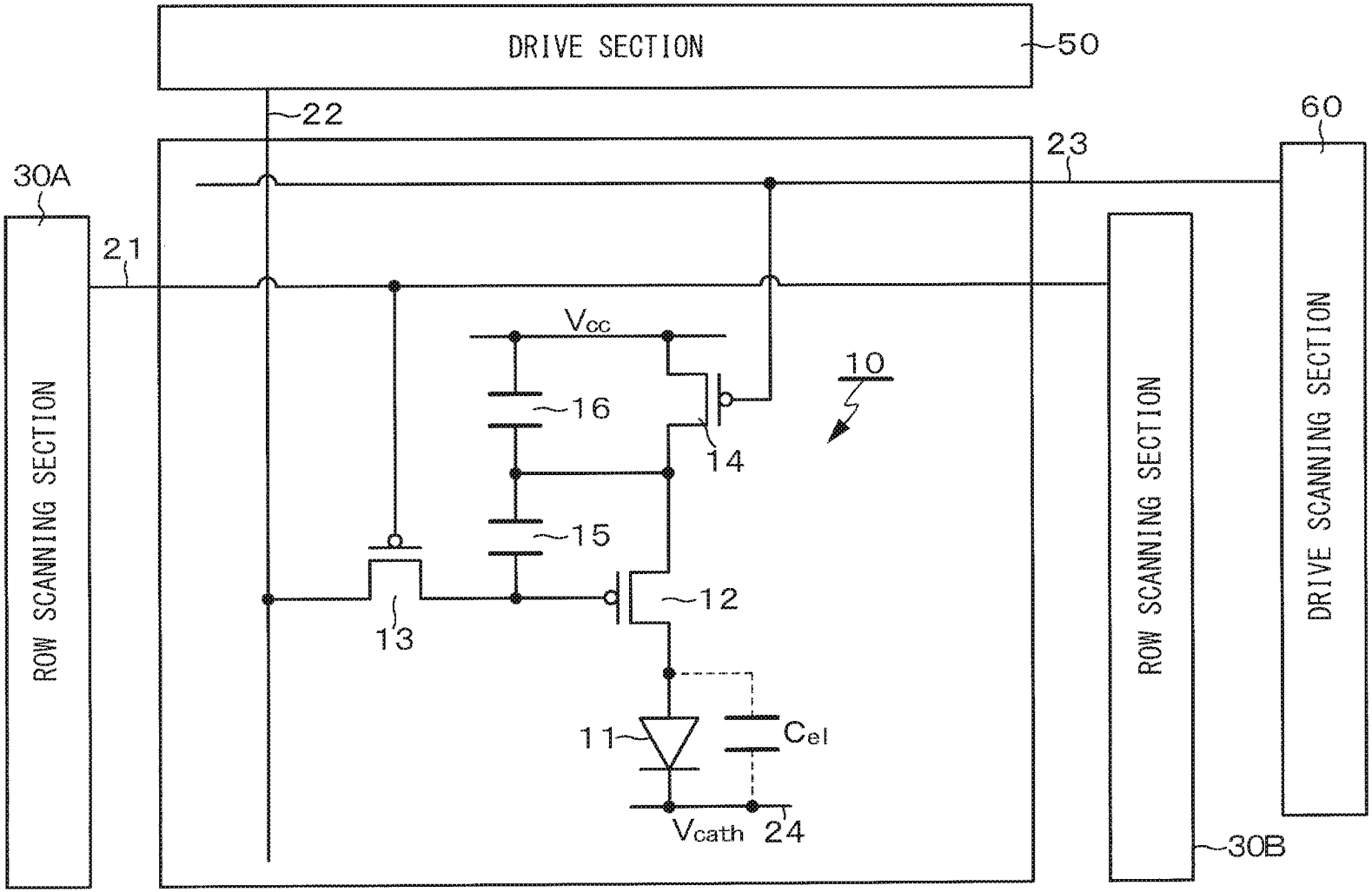
FIG. 3 is a circuit diagram illustrating an example of a configuration of a pixel (a pixel circuit) in the active matrix organic EL display unit.

FIG. 3 is a circuit diagram illustrating an example of a configuration of the pixel (pixel circuit) in the active matrix organic EL display unit.

As illustrated in FIG. 3, the pixel 10 is configured of an organic EL device 11 as an example of the current-driven light-emitting device and a drive circuit configured to drive the organic EL device 11 by allowing a current to flow through the organic EL device 11. A cathode electrode of the organic EL device 11 is connected to a common power supply line 24 wired to all of the pixels 10.

The drive circuit that drives the organic EL device 11 includes a drive transistor 12, a sampling transistor 13, a light emission control transistor 14, a retention capacitor 15, and an auxiliary capacitor 16. It is to be noted that, assuming that the drive circuit is formed not on an insulator such as a glass substrate but on a semiconductor such as silicon, a P-channel transistor is used as the drive transistor 12. Moreover, in this circuit example, as with the drive transistor 12, P-channel transistors are used as the sampling transistor 13 and the light emission control transistor 14.

In this circuit example, in addition to the drive transistor 12 and the sampling transistor 13, the light emission control transistor 14 is included as the pixel transistor. Therefore, in addition to the row scanning sections 30A and 30B illustrated in FIG. 1, the active matrix organic EL display unit includes a drive scanning section 60 configured to drive the light emission control transistor 14. The drive scanning section 60 outputs light emission control signals for driving of the light emission control transistors 14 from one row to another to control lines 23 wired to respective pixel rows.

In the pixel 10 with the above-described configuration, the sampling transistor 13 samples the signal voltage $V_{sig}$ of the image signal supplied from the drive section 50 through the signal line 22 during driving by scanning signals supplied from the row scanning sections 30A and 30B to write the signal voltage $V_{sig}$ to the pixel. The light emission control transistor 14 is connected in series to the drive transistor 12. More specifically, the light emission control transistor 14 is connected between the power supply $V_{cc}$ and a source electrode of the drive transistor 12, and performs control of emission/non-emission of light from the organic EL device 11 during driving by a light emission control signal supplied from the drive scanning section 60.

The retention capacitor 15 is connected between a gate electrode and the source electrode of the drive transistor 12, and holds the signal voltage $V_{sig}$ written by sampling by the sampling transistor 13. The drive transistor 12 allows a drive current corresponding to the signal voltage $V_{sig}$ held by the retention capacitor 15 to flow through the organic EL device 11, thereby driving the organic EL device 11 so as to emit light. The auxiliary capacitor 16 is connected between the source electrode of the drive transistor 12 and a node of a fixed potential, for example, the power supply $V_{cc}$, and exerts a function of reducing variation in a source potential of the drive transistor 12 caused when the signal voltage $V_{sig}$ is written.

In this case, since the organic EL device 11 is a current-driven light-emitting device, the organic EL device 11 obtains gray scales of light emission by controlling a current value flowing therethrough. To control the current value flowing through the organic EL device 11, an overdrive voltage when the signal voltage $V_{sig}$ of the image signal is written to the gate electrode of the drive transistor 12 to use the drive transistor 12 as a current source is controlled. The overdrive voltage is a higher voltage than a voltage allowing a desired gray scale to be obtained.

It is to be noted that, in this circuit example, the pixel circuit including the light emission control transistor 14 in addition to the drive transistor 12 and the sampling transistor 13 is described as an example; however, the pixel circuit may have a circuit configuration not including the light emission control transistor 14. Moreover, the pixel circuit using the P-channel transistor as the pixel transistor is described as an example; however, a pixel circuit using an N-channel transistor is not excluded.

2-4. About Power Supply Tolerance

Figure 4A:
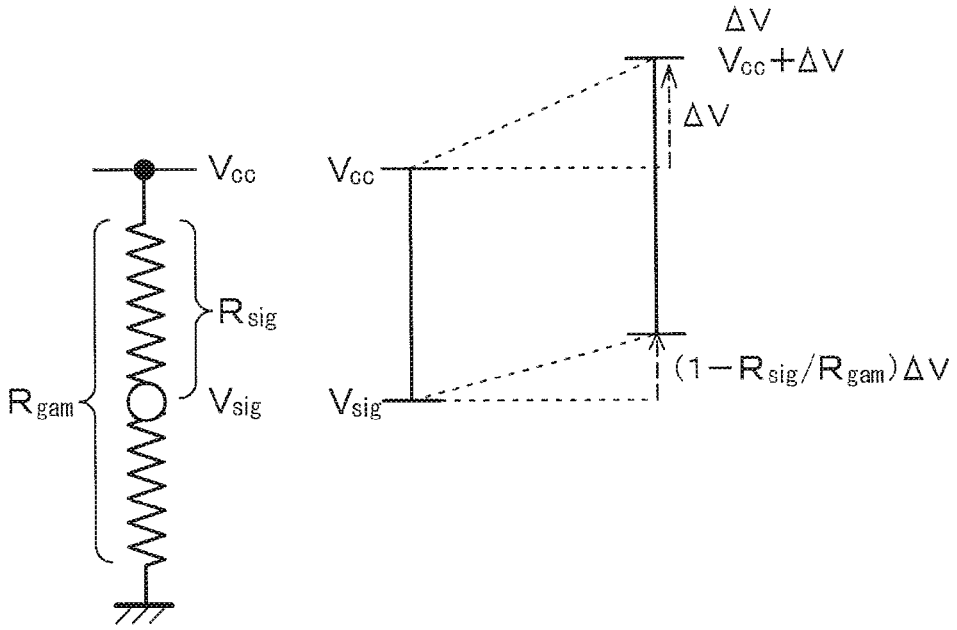
FIG. 4A is a diagram illustrating a state in which a voltage value of a gray-scale voltage is changed at a resistive voltage division ratio by a power supply tolerance.

In the gray-scale voltage generating circuit 40, when a gray-scale voltage is generated by resistive voltage division by the ladder resistor circuit 41, a voltage value of the gray-scale voltage is changed at a resistive voltage division ratio by a power supply tolerance of the power supply $V_{cc}$ of the gray-scale voltage generating circuit 40 (refer to FIG. 4A). In this case, for example, a case where the drive transistor 12 driving the organic EL device 11 is configured of a P-channel transistor, and the common power supply ($V_{cc}$) is used for the gray-scale voltage generating circuit 40 and the pixels 10 is considered. In this case, a change amount of the source potential and a change amount of the gate potential (a voltage value of the gray-scale voltage) in the drive transistor 12 are different from each other; therefore, the overdrive voltage of the drive transistor 12 is changed. As a result, a current $I_{oled}$ supplied from the drive transistor 12 to the organic EL device 11 is changed, thereby causing luminance change (refer to FIG. 4B). This luminance change is caused by the power supply tolerance, thereby causing luminance variations in the market of display panels.

In the ladder resistor circuit 41 schematically illustrated in FIG. 4A, an entire resistance value is $R_{gam}$, and a resistance value allowing the signal voltage (gray-scale voltage) $V_{sig}$ to be generated is $R_{sig}$. While the voltage $V_{cc}$ is changed only by a power supply tolerance ΔV, the voltage value of the gray-scale voltage is changed at the resistive voltage division ratio ($=R_{sig}/R_{gam}$).

Figure 4B:
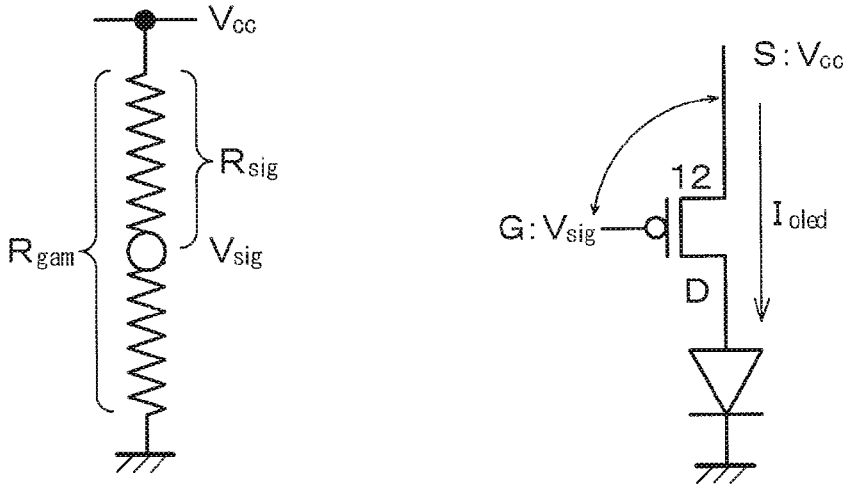
FIG. 4B is a diagram describing change in a current $I_{oled}$ supplied from a drive transistor to an organic EL device by change in the voltage value of the gray-scale voltage.

FIG. 4B illustrates an expression (1) that determines a desired current $I_{oled}$ flowing through the organic EL device 11 and an expression (2) that determines a current $I_{oLed}'$ flowing through the organic EL device 11 after change by the power supply tolerance ΔV. In these expressions (1) and (2), μ is mobility of a semiconductor thin film forming a channel of the drive transistor 12, $V_{th}$ is a threshold voltage, and $V_{gs}$ is a gate-source voltage. Moreover, W is a channel width of the drive transistor 12, L is a channel length, and Cox is a gate capacity per unit area.

3. Description of Embodiment

Figure 5A:
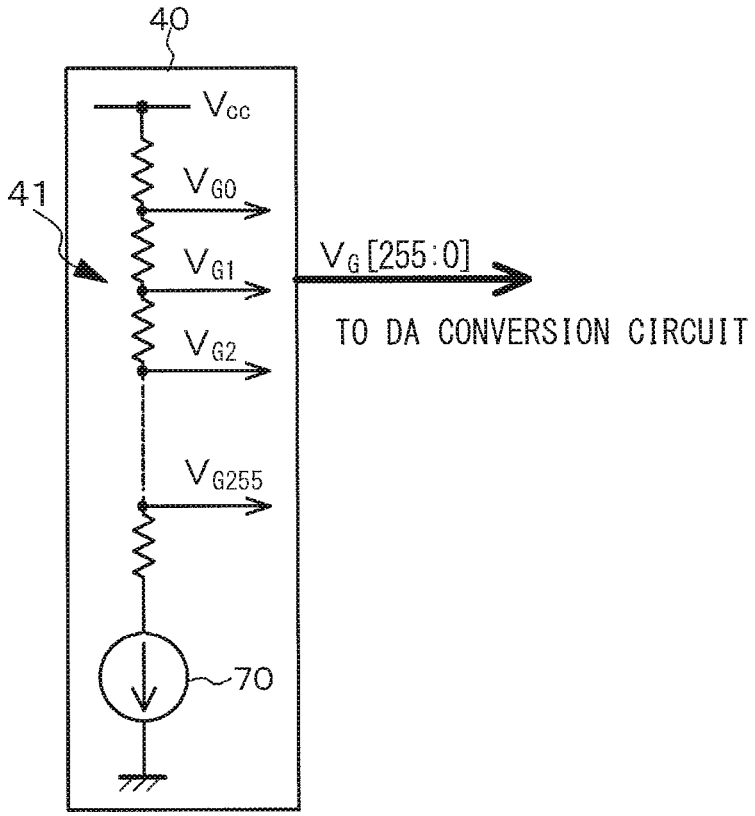
FIG. 5A is a circuit diagram illustrating a configuration of a gray-scale voltage generating circuit according to an embodiment of the present disclosure.

The technology of this embodiment of the present disclosure is made to reduce luminance change caused by the power supply tolerance ΔV. FIG. 5A is a circuit diagram illustrating a configuration of the gray-scale voltage generating circuit according to this embodiment of the present disclosure. As illustrated in FIG. 5A, the gray-scale voltage generating circuit 40 according to this embodiment includes a constant current source 70 connected in series to the ladder resistor circuit 41 outputting a plurality of gray-scale voltages with different voltage values, for example, 256 gray-scale voltages $V_{G0}$ to $V_{G255}$ from ends of the plurality of resistors.

Figure 5B:
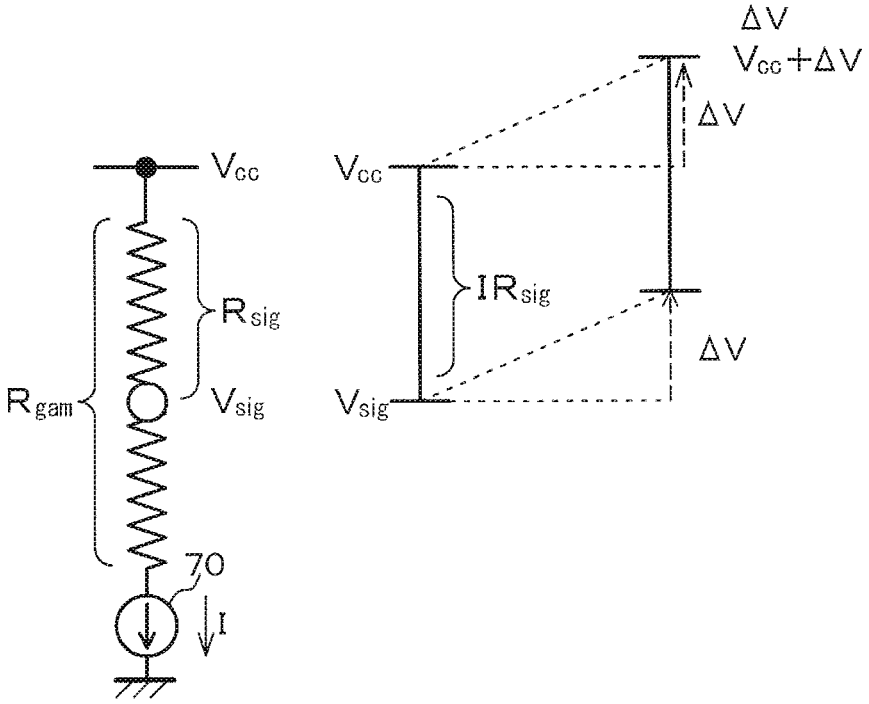
FIG. 5B is a diagram describing functions and effects of the gray-scale voltage generating circuit according to the embodiment.

In the gray-scale voltage generating circuit 40 with the above-described configuration according to this embodiment, as illustrated in FIG. 5B, the gray-scale voltages $V_{G0}$ to $V_{G255}$ are generated by an IR drop from the reference voltage $V_{cc}$ caused by a current value I of the constant current source 70 and a resistance value R ($R_{gam}$) of the ladder resistor circuit 41. Therefore, a potential difference between the reference voltage $V_{cc}$ and the gray-scale voltages $V_{G0}$ to $V_{G255}$ is constant. Thus, even though there is the power supply tolerance ΔV, a potential difference between the gate and the source of the drive transistor 12 is not changed; therefore, as long as the drive transistor 12 operates in a saturation region, luminance is not changed. Accordingly, luminance change caused by the power supply tolerance ΔV is allowed to be reduced.

Specific examples of the constant current source 70 will be described below.

3-1. Example 1

Figure 6:
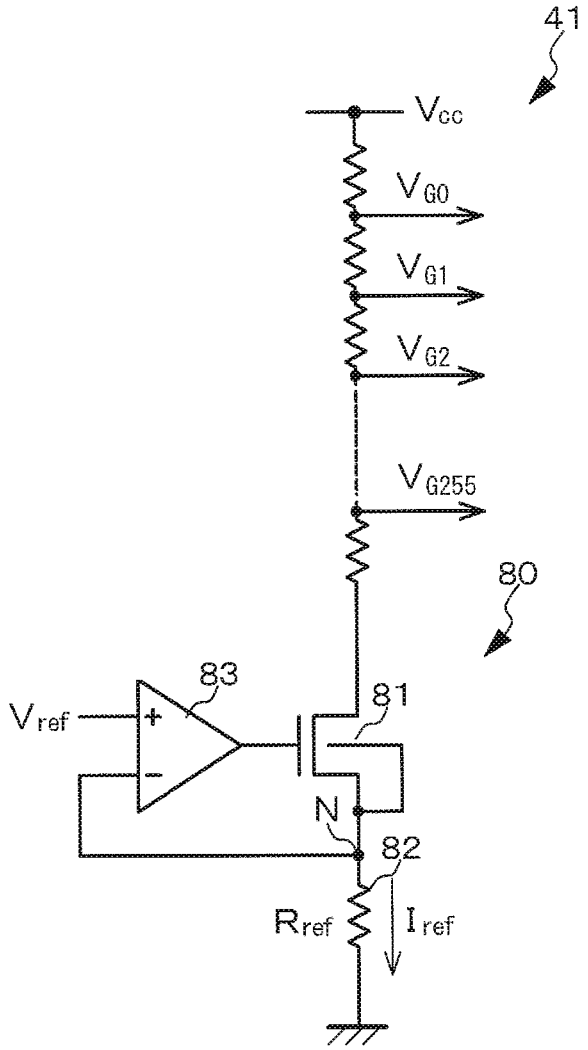
FIG. 6 is a circuit diagram illustrating a circuit configuration of a constant current source according to Example 1.

FIG. 6 is a circuit diagram illustrating a circuit configuration of a constant current source according to Example 1.

In Example 1, a current output amplifier 80 is used as the constant current source 70. As illustrated in FIG. 6, the current output amplifier 80 includes a current source transistor 81, a reference resistor 82, and a differential amplifier 83.

The current source transistor 81 is connected in series to the ladder resistor circuit 41. More specifically, one of source and drain electrodes of the current source transistor 81 is connected to an open end of a resistor on a lowest potential side of the ladder resistor circuit 41. The reference resistor 82 is connected in series to the current source transistor 81. More specifically, a first end of the reference resistor 82 is connected to the other one of the source and drain electrodes of the current source transistor 81, and a second end of the reference resistor 82 is connected to a power supply on the low potential side (in this example, a ground GND). The reference voltage $V_{ref}$ as a non-inverting (+) input and a voltage of a connection node N between the current source transistor 81 and the reference resistor 82 as an inverting (−) input are supplied to the differential amplifier 83, and the differential amplifier 83 drives the current source transistor 81, based on a difference voltage between the voltage of the connection node N and the reference voltage $V_{ref}$.

In the current output amplifier 80 with the above-described configuration, an output voltage of a known band gap reference circuit, as a kind of reference voltage circuit, that is not affected by the power supply tolerance ΔV may be preferably used as the reference voltage $V_{ref}$. The output voltage of the band gap reference circuit is typically 1.25 [V]. The output voltage comes from band gap energy of silicon.

Moreover, the reference resistor 82 may be preferably formed of a same member (for example, a poly-resistor) as a member of each of the resistors of the ladder resistor circuit 41 in proximity to the resistors of the ladder resistor circuit 41 by a same process as a process of forming each of the resistors of the ladder resistor circuit 41. When the reference resistor 82 is formed in such a manner, variations in the resistance value of the reference resistor 82 are allowed to be substantially equal to variations in the resistance value of each of the resistors of the ladder resistor circuit 41.

In this case, a current $I_{ref}$ flowing through the reference resistor 82 is determined by the following expression:

$$I_{ref}=V_{ref}/R_{ref}$$

where the resistance value of the reference resistor 82 is $R_{ref}$.

Moreover, the gray-scale voltage (signal voltage) $V_{sig}$ obtained by the ladder resistor circuit 41 is determined by the following expression:

$$\begin{aligned} V_{sig} &= R_{sig} \cdot I_{ref} \\ &= (R_{sig} / R_{ref}) V_{ref} \end{aligned}$$

Variations in the resistance value of each of the resistors of the ladder resistor circuit 41 or the reference resistor 82 occur. The current $I_{ref}$ flowing through the reference resistor 82 is determined by the following expression:

$$I_{ref} V_{ref}/\alpha R_{ref}$$

where a resistance variation coefficient of the variations is α.

On the other hand, in a case where the current output amplifier 80 is used as the constant current source 70, the gray-scale voltage (signal voltage) $V_{sig}$ obtained by the ladder resistor circuit 41 is determined by the following expression:

$$\begin{aligned} V_{sig} &= \alpha R_{sig} \cdot I_{ref} \\ &= (\alpha R_{sig} / \alpha R_{ref}) V_{ref} \\ &= (R_{sig} / R_{ref}) V_{ref} \end{aligned}$$

As can be seen from the above-described expression, the resistance value is included both in voltage-current conversion and current-voltage conversion; therefore, the resistance variation coefficient α is eliminated.

In other words, when the constant current source 70 is connected in series to the ladder resistor circuit 41 and the current output amplifier 80 is used as the constant current source 70, variations in the resistance value of the ladder resistor circuit 41 is allowed to be cancelled. Therefore, the gray-scale voltage (signal voltage) $V_{sig}$ generated by the gray-scale voltage generating circuit 40, i.e., the ladder resistor circuit 41 is allowed to be constant irrespective of variations in the resistance value of the ladder resistor circuit 41.

3-2. Example 2

In Example 1, as the reference voltage $V_{ref}$ that is to be applied to the differential amplifier 83 as the non-inverting (+) input, the output voltage (band gap reference voltage) of the band gap reference circuit is used; however, there is an individual difference in the band gap reference voltage (reference voltage) $V_{ref}$.

Figure 7:
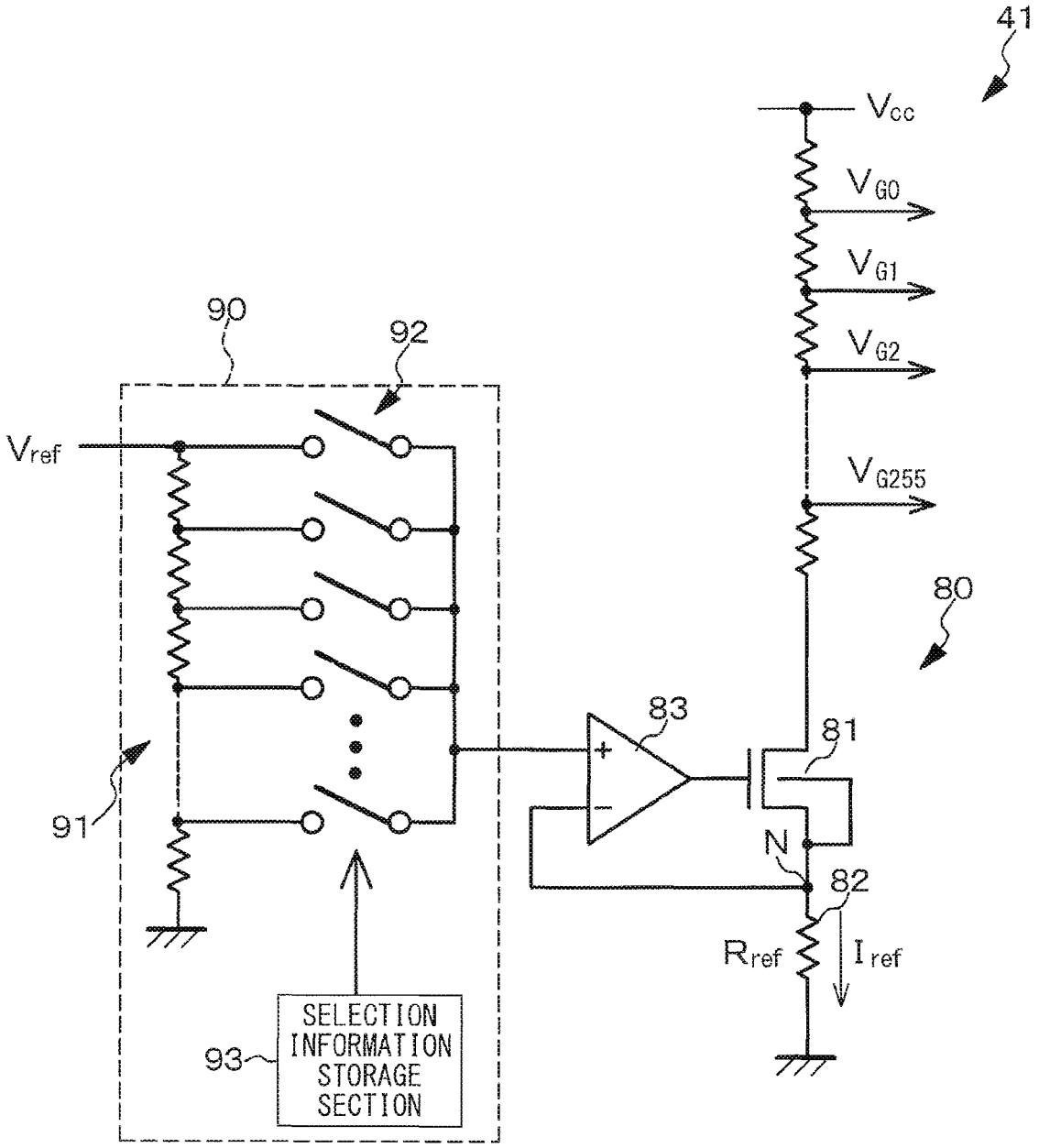
FIG. 7 is a circuit diagram illustrating a circuit configuration of a constant current source according to Example 2.

Example 2 is made to eliminate an influence of the individual difference in the reference voltage (reference voltage) $V_{ref}$. FIG. 7 is a circuit diagram illustrating a circuit configuration of a constant current source according to Example 2. Example 2 adopts a configuration in which a voltage setting section 90 is used in addition to the current output amplifier 80. The voltage setting section 90 is configured to select one voltage from a plurality of voltages and set the selected voltage as the reference voltage that is to be applied to the differential amplifier 83 as the non-inverting (+) input.

The voltage setting section 90 includes a voltage output section 91, a voltage selection section 92, and a selection information storage section 93. The voltage output section 91 is configured of a ladder resistor circuit. The ladder resistor circuit includes a plurality of resistors connected in series to one another, and is configured to output a plurality of voltages from ends of the respective resistors. The ladder resistor circuit is connected between the first power supply as a power supply on a high-potential side and the second power supply (in this example, the ground GND) as a power supply on a low-potential side, and the voltage of the first power supply serves as the reference voltage $V_{ref}$, and the reference voltage $V_{ref}$ is a highest voltage in the plurality of voltages. As the reference voltage $V_{ref}$, the band gap reference voltage may be used.

The voltage selection section 92 includes a plurality of switch devices (for example, resistors) in which first ends thereof are connected to ends (nodes) of the respective resistors of the ladder resistor circuit, and second ends thereof are connected to a common member, and is configured to select one voltage from a plurality of voltages, based on selection information supplied from the selection information storage section 93. The voltage selected by the voltage selection section 92 is applied to the differential amplifier 83 as a non-inverting input. Selection information corresponding to an individual difference in the reference voltage $V_{ref}$ and variations in characteristics of the differential amplifier 83 and the like are stored in advance in the selection information storage section 93.

In the above-described Example 2, as with Example 1, when the current output amplifier 80 is used as the constant current source 70, change in the voltage values of the gray-scale voltages $V_{G0}$ to $V_{G255}$ caused by variations in the resistance value of the ladder resistor circuit 41 is allowed to be corrected by an effect of the current output amplifier 80. In addition, Example 2 has an advantage that, when one voltage is selected from a plurality of voltages and the selected voltage is set as the reference voltage that is to be applied to the differential amplifier 83 as the non-inverting (+) input, the individual difference in the reference voltage $V_{ref}$ and variations in characteristics of the differential amplifier 83 and the like are allowed to be corrected.

4. Configuration of Present Disclosure

It is to be noted that the present disclosure may have the following configurations.

[1] A gray-scale voltage generating circuit including:

a ladder resistor circuit including a plurality of resistors connected in series to one another, and configured to output a plurality of gray-scale voltages with different voltage values from ends of the respective resistors; and a constant current source configured to be connected in series to the ladder resistor circuit.

[2] The gray-scale voltage generating circuit according to [1], in which the constant current source is configured of a current output amplifier.

[3] The gray-scale voltage generating circuit according to [2], in which the current output amplifier includes a current source transistor configured to be connected in series to the ladder resistor circuit, a reference resistor configured to be connected to one of source and drain electrodes of the current source transistor, and a differential amplifier configured to drive the current source transistor, based on a difference voltage between a voltage of a connection node between the current source transistor and the reference resistor and a predetermined reference voltage.

[4] The gray-scale voltage generating circuit according to [3], in which the predetermined reference voltage is an output voltage of a band gap reference circuit.

[5] The gray-scale voltage generating circuit according to [3] or [4], in which the reference resistor is formed in proximity to the resistors of the ladder resistor circuit.

[6] The gray-scale voltage generating circuit according to [5], in which the reference resistor is formed of a same member as a member of each of the resistors of the ladder resistor circuit.

[7] The gray-scale voltage generating circuit according to [5] or [6], in which the reference resistor is formed by a same process as a process of forming each of the resistors of the ladder resistor circuit.

[8] The gray-scale voltage generating circuit according to any one of [3] to [7], further including a voltage setting section configured to select one voltage from a plurality of voltages and set the selected voltage as the predetermined reference voltage that is to be supplied to the differential amplifier.

[9] The gray-scale voltage generating circuit according to [8], in which the voltage setting section includes a voltage output section including a plurality of resistors connected in series to one another between a first power supply and a second power supply, and configured to output a plurality of voltages from ends of the respective resistors, and a voltage selection section configured to select one voltage from the plurality of voltages and set as the selected voltage as the predetermined voltage that is to be supplied to the differential amplifier.

[10] The gray-scale voltage generating circuit according to [9], in the voltage selection section selects one voltage from the plurality of voltages, based on variations in characteristics of the differential amplifier.

[11] A display unit including:

a pixel section configured by arranging pixel circuits each including a light-emitting device;

a gray-scale voltage generating circuit including a ladder resistor circuit and a constant current source, the ladder resistor circuit including a plurality of resistors connected in series to one another, and configured to output a plurality of gray-scale voltages with different voltage values from ends of the respective resistors, the a constant current source configured to be connected in series to the ladder resistor circuit; and a drive section configured to convert an input digital image signal into an analog image signal by selecting one gray-scale voltage corresponding to the digital image signal from the plurality of gray-scale voltages generated by the gray-scale voltage generating circuit and drive the light-emitting device by the analog signal.

[12] The display unit according to [11], in which the pixel circuit includes a drive transistor, the drive transistor configured of a P-type transistor and configured to supply a current corresponding to a gate potential to the light-emitting device.

[13] The display unit according to [11] or [12], in which a common power supply is used for the pixel circuits and the ladder resistor circuit.

[14] The display unit according to any one of [11] to [13], in which the light-emitting device is an organic electroluminescence device.

[15] The display unit according to any one of [11] to [14], in which a resistance value of each of the resistors of the ladder resistor circuit is determined, based on gamma characteristics of the pixel section.

It should be understood by those skilled in the art that various modifications, combinations, sub-combinations, and alterations may occur depending on design requirements and other factors insofar as they are within the scope of the appended claims or the equivalents thereof.

What is claimed is:

1. A gray-scale voltage generating circuit, comprising:

a ladder resistor circuit including a first plurality of resistors connected in series, wherein the ladder resistor circuit is configured to output a first gray-scale voltage from a first resistor of the first plurality of resistors, wherein a resistance value of the first resistor is set based on gamma characteristics of a pixel section connected to the ladder resistor circuit, wherein the pixel section emits light based on the first gray-scale voltage;

a constant current source connected in series to the ladder resistor circuit, wherein the constant current source comprises a current output amplifier, and wherein the current output amplifier comprises a current source transistor, a reference resistor, and a differential amplifier; and a voltage setting section that comprises a voltage selection section, wherein the voltage selection section is configured to select a first voltage from a plurality of voltages based on stored information related to the differential amplifier, and set the first voltage as a reference voltage that is supplied to the differential amplifier.

2. The gray-scale voltage generating circuit according to claim 1, wherein the current source transistor connected in series to the ladder resistor circuit, wherein the reference resistor is connected to one of a source electrode or a drain electrode of the current source transistor, and wherein the differential amplifier is configured to drive the current source transistor based on a difference between a second voltage of a connection node and the reference voltage, wherein the connection node is between the current source transistor and the reference resistor.

3. The gray-scale voltage generating circuit according to claim 2, wherein the reference voltage is an output voltage of a band gap reference circuit.

4. The gray-scale voltage generating circuit according to claim 2, wherein a first end of the reference resistor is connected in series to the current source transistor, and a second end of the reference resistor is connected to a ground potential.

5. The gray-scale voltage generating circuit according to claim 2, wherein the reference resistor is made of a same member as each of the first plurality of resistors of the ladder resistor circuit.

6. The gray-scale voltage generating circuit according to claim 2, wherein the reference resistor is made by a same process used to make each of the first plurality of resistors of the ladder resistor circuit.

7. The gray-scale voltage generating circuit according to claim 2, wherein the voltage setting section is configured to select a third voltage from the plurality of voltages and set the selected third voltage as the reference voltage.

8. The gray-scale voltage generating circuit according to claim 7, wherein the voltage setting section further includes a voltage output section that includes a second plurality of resistors connected in series between a first power supply and a second power supply, wherein the voltage output section is configured to output the plurality of voltages from the second plurality of resistors.

9. The gray-scale voltage generating circuit according to claim 1, wherein a number of gray-scale voltages generated by the ladder resistor circuit is $2^N$, wherein N is a number of bits in an input digital image signal for conversion to an analog image signal.

10. The gray-scale voltage generating circuit according to claim 1, wherein the ladder resistor circuit is further configured to output a second gray-scale voltage from a second resistor of the first plurality of resistors, wherein the first gray-scale voltage is different from the second gray-scale voltage.

11. A display unit, comprising:

a pixel section that includes an arrangement of pixel circuits, wherein each of the pixel circuits includes a light-emitting device;

a gray-scale voltage generating circuit including a ladder resistor circuit, a constant current source, and a voltage setting section, wherein the ladder resistor circuit includes a plurality of resistors connected in series, wherein the ladder resistor circuit is configured to output a gray-scale voltage from a resistor of the plurality of resistors, wherein the constant current source is connected in series to the ladder resistor circuit, wherein the constant current source comprises a current output amplifier, wherein the current output amplifier comprises a current source transistor, a reference resistor, and a differential amplifier, wherein a resistance value of the resistor is set based on gamma characteristics of the pixel section connected to the ladder resistor circuit, wherein the pixel section is configured to emit light based on the gray-scale voltage, wherein the voltage setting section comprises a voltage selection section, and wherein the voltage selection section is configured to select a voltage from a plurality of voltages based on stored information related to the differential amplifier, and set the selected voltage as a reference voltage that is supplied to the differential amplifier; and a drive section configured to convert an input digital image signal into an analog image signal based on the gray-scale voltage that corresponds to the input digital image signal, and drive the light-emitting device by the analog image signal.

12. The display unit according to claim 11, wherein each of the pixel circuits includes a drive transistor, wherein the drive transistor includes a P-type transistor, and wherein the drive transistor is configured to supply a current that corresponds to a gate potential to the light-emitting device.

13. The display unit according to claim 11, wherein the pixel circuits and the ladder resistor circuit are powered by a common power supply.

14. The display unit according to claim 11, wherein the light-emitting device is an organic electroluminescence device.

15. A gray-scale voltage generating circuit, comprising:

a ladder resistor circuit including a first plurality of resistors connected in series, wherein the ladder resistor circuit is configured to output a plurality of gray-scale voltages with different voltage values from ends of respective resistors of the first plurality of resistors;

a constant current source connected in series to the ladder resistor circuit, wherein the constant current source includes a current output amplifier, wherein the current output amplifier includes:

a current source transistor connected in series to the ladder resistor circuit, a reference resistor connected to one of a source electrode or a drain electrode of the current source transistor, and a differential amplifier configured to drive the current source transistor, based on a difference between a voltage of a connection node and a determined reference voltage, wherein the connection node is between the current source transistor and the reference resistor; and a voltage setting section configured to select a voltage from a plurality of voltages and set the selected voltage as the determined reference voltage that is to be supplied to the differential amplifier, wherein the voltage setting section includes:

a voltage output section including a second plurality of resistors connected in series between a first power supply and a second power supply, and wherein the voltage output section is configured to output the plurality of voltages from the second plurality of resistors, and a voltage selection section configured to:

select the voltage from the plurality of voltages based on stored information related to the differential amplifier and set the selected voltage as the determined reference voltage.

* * * * *